US008029182B2

(12) United States Patent
Chien

(10) Patent No.: US 8,029,182 B2
(45) **Date of Patent: *Oct. 4, 2011**

(54) LED NIGHT LIGHT WITH LIQUID OPTICS MEDIUM

(76) Inventor: Tseng-Lu Chien, Taipei Hseng (TW)

( * ) Notice: Subject to any disclaimer, the term of this patent is extended or adjusted under 35 U.S.C. 154(b) by 0 days.

This patent is subject to a terminal disclaimer.

(21) Appl. No.: 12/546,012

(22) Filed: Aug. 24, 2009

(65) Prior Publication Data

US 2009/0310383 A1 Dec. 17, 2009

Related U.S. Application Data

(63) Continuation of application No. 11/094,215, filed on Mar. 31, 2005, now Pat. No. 7,909,477.

(51) Int. Cl.
*F21V 33/00* (2006.01)

(52) U.S. Cl. ..... 362/642; 362/644; 362/101; 362/806

(58) Field of Classification Search ..... 362/641–644, 362/96, 101, 318, 806, 249.02, 231, 249.06, 362/249.14, 249.16

See application file for complete search history.

(56) References Cited

U.S. PATENT DOCUMENTS

| | | | | |
|---|---|---|---|---|
| 6,000,807 | A * | 12/1999 | Moreland | 362/95 |
| 6,168,282 | B1 * | 1/2001 | Chien | 362/84 |
| 6,179,431 | B1 * | 1/2001 | Chien | 362/84 |
| 6,431,719 | B1 * | 8/2002 | Lau et al. | 362/95 |
| 2006/0062019 | A1 * | 3/2006 | Young | 362/641 |
| 2006/0164823 | A1 * | 7/2006 | Jao | 362/101 |

* cited by examiner

*Primary Examiner* — Thomas Sember

(74) *Attorney, Agent, or Firm* — Bacon & Thomas, PLLC

(57) ABSTRACT

An LED night light includes a liquid optics medium arrangement that lets visible wavelength light beams pass through the liquid optics medium to a viewer. The liquid optics medium may include miniature floating objects made from textile, metal, plastic, porcelain, ceramic, dry flower, wood, plants, and/or potpourri in the shape of toys, stuffed animals, blow-molded units, seasonal items, dolls, etc. for a variety of gift, toy, sports, seasonal, or holiday applications. The night light may further incorporate a heater element to cause the liquid medium to flow and cause movement of the miniatures.

1 Claim, 6 Drawing Sheets

FIG.2
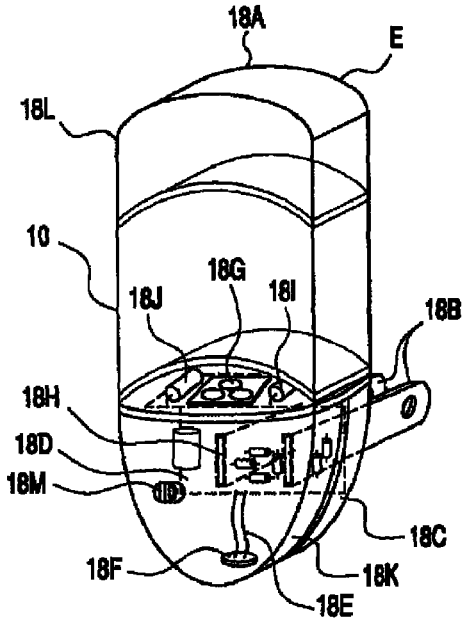
FIG.2A
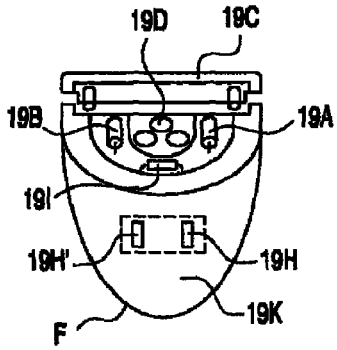
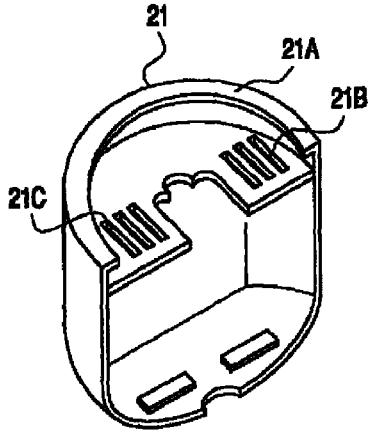
FIG.3A
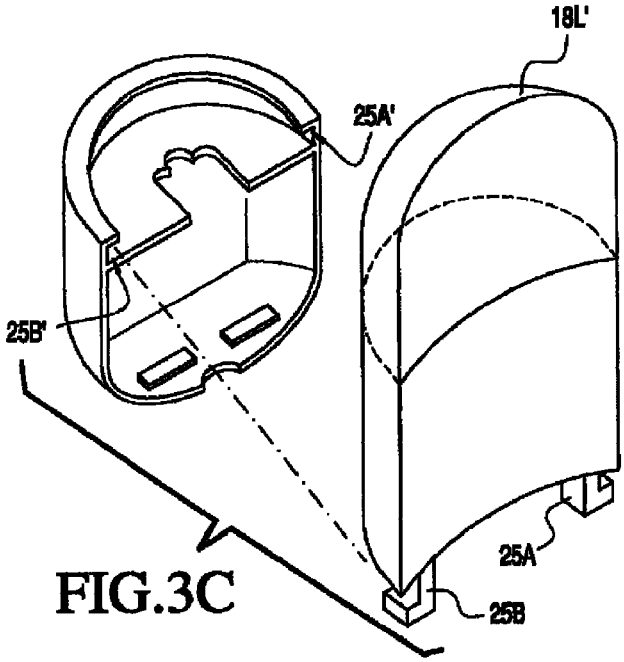
FIG.3C
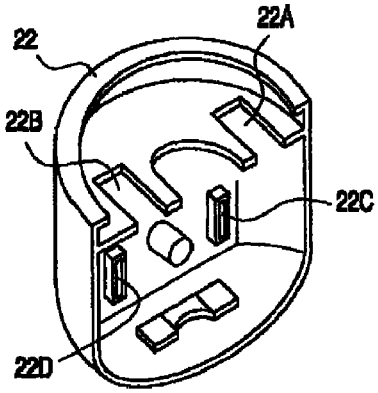
FIG.3B

LED NIGHT LIGHT WITH LIQUID OPTICS MEDIUM

This application is a continuation of nonprovisional application Ser. No. 11/094,215, filed Mar. 31, 2005, now U.S. Pat. No. 7,909,477.

BACKGROUND

This application is related to U.S. patent application Ser. No. 10/883,747, now U.S. Pat. No. 6,976,762, Ser. No. 10/954,189, now abandoned, Ser. No. 10/667,787, now abandoned, and Ser. No. 10/286,871, now abandoned, which are directed to light kits for footwear, a multiple function wall cover plate, a multiple function night light, and a linear tube night light with changeable light patterns. In addition, the inventor's prior U.S. Pat. Nos. 5,926,440, U.S. Pat. No. 6,158,868, U.S. Pat. No. 6,170,958, U.S. Pat. No. 6,171,117, U.S. Pat. No. 6,280,053 disclose conductor arrangements for a night light and a multiple function night light incorporated with a time piece. Other U.S. Pat. Nos. 4,947,291, 5,495,402, 5,662,408, 5,713,655, 5,803,579, 5,816,682, 5,833,350, 5,893,626, 5,998,928, 6,000,807, 6,010,228, 6,031,958, 6,033,087, 6,056,420, 6,132,072, 6,160,948, 6,161,910, 6,183,101, 6,190,017, 6,290,368, 6,337,946, 6,386,730, 6,390,647, 6,00,104, 6,411,524, 6,431,719, 6,509,832, 6,523,976, 6,550,949, 6,609,812, 6,623,416, 6,641,289, 6,648,496, 6,709,126, 5,803,579, 6,033,087, 6,031,958, 6,161,910, 6,24,273, 6,280,051, 6,431,719, 6,561,677, 6,648,496, 6,709,126, and 6,811,281 all show different light sources and applications therefore, but none teaches an LED night light incorporated with a liquid optics medium having miniatures therein to create a medium with motion and optics properties including reflective, refractive, and randomly changing optical properties resulting from motion of the miniatures within the medium.

The prior art U.S. Pat. No. 6,709,126 disclosure a LED night light with a rotating base with 2 LED light means (80) install to let the people directly to see the LED light beam. The Prior art U.S. Pat. No. 6,648,496 discloses an arrangement in which one LED is installed on 4 corners of a cover plate with focusing features. Prior art U.S. Pat. No. 6,431,719 discloses an arrangement of LEDs behind a translucent lens that lets people directly see the LED's light beams, in which the LED arrangement is an out of date three piece LED array. The current state-of-the-art LED uses only one single piece to provide a multiple color spectral output for cost and spacing saving consideration. In contrast, the current invention utilizing LEDs as light means incorporates the liquid optics medium causes the LED light beam to be indirectly viewed due to the optics properties of the miniatures suspended therein. The features and detailed construction of the current invention's light arrangement is totally different than that of the '719 patent.

More particularly, the arrangement disclosed in prior U.S. Pat. No. 6,431,719 differs from the current invention according to the following comparison:

(C1) The night light of the '719 patent uses a three piece LED arrangement to provide a light source with R/G/B colors having continuously changing patterns of differently colored light while a prong means is connected with a light source. This is only one of the functions of the current invention. The current invention has a plurality of functions built inside the circuit means to provide a night light which when connected with a power source, will initially have a first light function, and which can be changed to another function while using the switch means to select from a plurality of functions, and stay with the next function until reset.

(C2) The '179 patent teaches use of several piece LEDs (30) (column 2, lines 6-7), "three separated LEDs" (col. 2, lines 40-45), and that "the three LEDs are series connected . . . " (col. 2, lines 48-51). All these technical features are out of date and need too big a space for arrangement. The current invention preferably uses a single LED with different color dies inside to save space and cost for the application to fit into the limited space of a night light's housing.

(C3) The light beam of the current invention can be seen by a viewer only after passing through a medium that provides a light path with reflective, refractive, diffusion, and randomly changing properties caused by the medium material and surfaces of suspended miniatures so the visible light beam is more changeable, especially when incorporated with a heater means that will cause the liquid to flow and provide stream effects, thereby increasing the eye-catching effects.

(C4) In the current invention, the LEDs are not visible directly from viewer. The viewer only sees the light beam indirectly through the medium.

Prior U.S. Pat. No. 6,648,496 discloses the same LED light functions as the '719 patent, but in a wall cover plate. Prior U.S. Pat. No. 6,709,126 discloses a rotating base and LED light arrangement on a post, but in which the light still can be directly seen in a manner similar to the light of the '719 patent, but with other features.

The LED night light with liquid optics medium of the invention can let visible wavelength light beams be seen by a viewer through the miniatures arranged within the liquid optics medium so as to create splendid light effects and a valuable appearance of the night light. The motion effects of the miniatures may be enhanced by adding a heater element near the bottom of the medium to generate currents. The heater element can include a resistor (h1) formed by a printed circuit board (b2) with conductive paths increasing in width narrow to wide to cause electricity passing through to go from cold to a higher temperature. The heater means are located under or attached to the medium to cause the medium to create a flow or stream to cause movement of the miniatures.

The miniatures within the medium media may be made oaf any material, such as (mi 1) a shell, (mi 2) leaves, (mi 3) a dry flower, (mi 4) potpourri, (mi 5) a flower, (mi 6) a plastic piece, (mi 7) floating stuff, (mi 8) fish, (mi 9) animals, (mi 10) a smiling face, (mi 11) a metal piece, (mi 12) a paper piece, (mi 13) a wood piece, (mi 14) a seed, (mi 15) a boat, (mi 16) a snow flake, (mi 17) a tree, or (mi 18) any material with designed shape and color, and/or with a design, indicia, drawing, color, painting, or coating thereon, which are available to put within the medium means and enhance the value and appearance of the medium so that it looks like conventional gift items which including a scene inside such as seasonal water ball, artificial aquarium, or kids toy with a sealed liquid.

The medium may be selected from (m1) oil, (m2) a solid plastic body, (m3) a transparent material, or (m4) any medium means which has a desired gravity, viscosity, and/or density, and which has reflective, diffusion, or optics properties and that may incorporate the LED light source to increase the value and appearance of or accent the night light.

The night light's configuration and shape may be selected from a toy, gift, souvenir, seasonal unit, holiday unit, painting, poster, sign, photo, artificial flower, doll, porcelain unit, ceramic unit, viscous-mud related unit, blow-mold unit, stuffed toys unit, promotion unit or any conventional unit in the marketplace.

The LED night light also can be appropriately arranged to as a stencil, indicia, front sheet, cover piece, or outside appearance piece with LED light means arranged to create expected light effects. The LED light means add a liquid optics medium means, miniature means, or related multiple function circuit to increase the light effects when the night light's prong is inserted into a wall outlet receptacle.

The LED night light with liquid optics medium may incorporate a circuit means capable of providing various lighting effects, such as (f1) steady, (f2) chasing, (f3) random, (f4) fade in and fade out, (f5) sequential, (f6) pair flashing, (f7) scan, (f8) color mixed, (f9) color changing, (f10) all flashing or (f11) any combinations for light effects available from the marketplace. All these functions can be designed to have a predetermined time, duration, order, and function as required.

The LED night light with liquid optics medium may also incorporate other electric devices such as (o1) motor, (o2) movement, (o3) filter device, (o4) IC chips with desired functions, (o5) sensor, and/or (o6) rotating filter to provide preferable light effects and functions.

Still further, the LED light means may be selected from the group including dice, chips, and/or a sealed unit of the LED depending on space limitations and functions required by related circuit means and control means to provide proper illumination with desired functions and effects.

Preferably, the LED light beams pass though the liquid optics medium to the viewer at visible wavelengths to get a plurality of light patterns effects when prong means are connected with a power source. The feature of having the LED device be incorporated with heater means enables the liquid optics medium means and miniatures means to have motion effects to increase the night light value and appearance.

BRIEF DESCRIPTION OF THE DRAWINGS

FIGS. 2 and 2A illustrate the first embodiment, including an LED night light with liquid optics medium and heater means.

FIGS. 3A, 3B and 3C illustrate the first embodiment, including an LED night light with liquid optics medium and heater means having heat holes.

DETAILED DESCRIPTION OF THE PREFERRED EMBODIMENTS

Figure 1A:
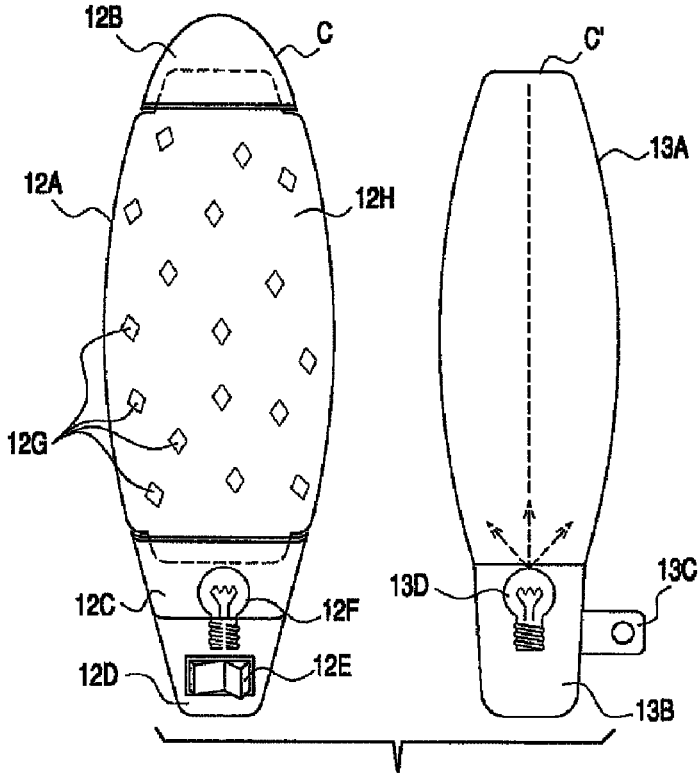
FIG.1A Prior Art
FIG. 1A shows a prior art LED light means.

An LED night light with liquid optics medium includes (A) prong means, (B) circuit means, (C) LED light means, (D) medium means, (E) heater means, and (F) housing, and optionally may further include (F) miniature means, and (G) other device(s), to provide a splendid light performance and let the light beams pass though the medium means with optics properties to be seen by a viewer. The LED light beams pass to the viewer through the liquid optics medium at visible wavelengths to provide a plurality of light patterns effects when prong means of the light means are connected with a power source. The feature of having the LED multiple functions light beams incorporated with heater means to cause the liquid optics medium means and miniatures means exhibit motion effects to increase the night light's value and appearance.

The light means is a sculpture and new LED which only has a single piece unit with built-in dies of different color with IC control to make different light functions.

The LED light means may be selected from the group consisting of a die, chip, and/or sealed LED unit depending on space limitations and required functions related circuit means and control means to provide proper illumination with desired functions and effects.

The LED night light with liquid optics medium may incorporate appropriate circuit means which can have a desired function selected from the group of functions including (f1) steady, (f2) chasing, (f3) random, (f4) fade in and fade out, (f5) sequential, (f6) pair flashing, (f7) scan, (f8) color mixed, (f9) color changing, (f10) all flashing or (f11) any combinations thereof an all other light effects available from marketplace. All these functions can be designed to have a predetermined time, duration, order, and function as required. All these preferable functions are built-in the circuit means and can be selected and changed from one function to another by a control means.

The medium means may be selected from (m1) oil, (m2) a solid plastic body, (m3) light passing through a material, or (m4) any medium means which has desired gravity, viscosity, and/or density which can cause the light to have reflective, diffractive, or other optical properties that increase the value, appearance, or accent of the night light.

The miniatures means are within the medium means and may be any material such as (mi 1) a shell, (mi 2) leaves, (mi 3) dry flower, (mi 4) potpourri, (mi 5) flower, (mi 6) plastic piece, (mi 7) floating stuff, (mi 8) fish, (mi 9) animals, (mi 10) smiling face, (mi 11) metal piece, (mi 12) paper piece, (mi 13) wood piece, (mi 14) seed, (mi 15) boat, (mi 16) snow flake, (mi 17) tree, or (mi 18) any material with predetermined shape and colors, and/or with a design, indicia, drawing, color, painting, or coating which is available to put within the medium means to increase the value by improving the appearance to cause the medium means to look like conventional gift items of the type which include a scene inside, such as a seasonal water ball, artificial aquarium, or kid's toy with sealed liquid applications.

The night light's configuration and shape may be selected from group that includes a toy, gift, souvenir, seasonal unit, holiday unit, painting, poster, sign, photo, artificial flower, doll, porcelain unit, ceramic unit, viscous-mud related unit, blow-mold unit, stuffed toy unit, promotion unit or any conventional unit available in the marketplace.

The LED night light with liquid optics medium may incorporate another device such as a (o1) motor, (o2) movement, (o3) filter device, (o4) IC chips with desired functions, (o5) sensor, (o6) or rotating filter to make preferable light effects and functions.

Motion effects of the miniature means are caused by adding a heater element near or adjacent to the bottom of the medium means. The heater means can be implemented by (h1) a resistor (h2) or printed circuit board with conductive path from narrow to wide to cause the electricity passing through change from small to higher density and replace cold with a higher temperature. The heater means are located under and attached to the medium means to cause the medium means to create a flow or stream that in turn causes movement of the miniature means.

By way of comparison, the arrangement disclosed in prior U.S. Pat. No. 6,431,719 differs from the current invention in the following respects:

(C1) The night light of the prior patent uses three LEDs as a light source to provide R/G/B colors with continuously changing patterns of differently colored light when the prong means connected with light source. This is only one function of the current invention. The current invention may have a plurality of functions built inside the circuit means. The night light connected with power source will have a first light function and can be changed to another function by using the switch means to select from a plurality of functions and switch to the next function until reset.

(C2) The '719 patent teaches use of multiple LEDs (30) (column 2, lines 6-7), "three separated LEDs," (Column 2, line 40-45), and that the "three LEDs are series connected . . . " (Column 2, line 48-51). The technology taught in the '729 patent is out of date and needs too big a space. The current invention preferably uses a single LED with different color dies inside to save space and cost for the application to fit into the limited space of a night light's housing.

(C3) The light beam seen by a viewer of the current invention passes through the medium means along a light path a that may include reflection, deflection, diffusion, or randomness created by the medium material and suspended miniature means' surfaces so that the visible light beam is changeable, especially when incorporated with heater means that will cause the liquid to flow and thereby provide even more eye-catching effects.

(C4) In the current invention, the LEDs are not visible directly by the viewer. The viewer only sees the light beam indirectly through the medium means.

Prior U.S. Pat. No. 6,648,496 discloses the same LED light functions as the '719 patent, but the application involves a wall cover plate for different categories. Prior U.S. Pat. No. 6,709,126 discloses a rotating base and LED light arrangement on a post, but still with direct viewing of the light from the LED in a manner similar to that of the '719 patent, but with other features.

FIG. 1A illustrates a prior art bulb night light (C) having a bulb (12F) below a medium means (12H), and in which the heat created by the filament bulb (12F) activates a switch (12D) to turn the bulb on and off. This prior art does not have multiple functions light effects but rather just turns on and off the bulb. From the embodiment (C'), one can see the construction of this prior art. This prior art lacks multiple colors or multiple functions of the light beams.

Figure 1B:
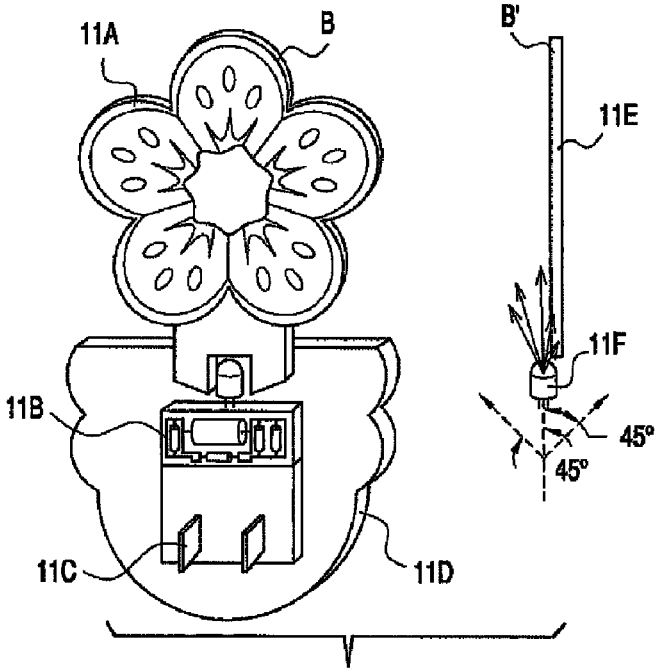
FIG.1B Prior Art
FIG. 1B shows a prior art bulb light means and liquid container.

FIG. 1B, shows a prior art LED night light (B) having an upper plastic piece with very thin material so as to have lower cost for a plastic stencil. An LED light means on a circuit means (11B) with prong means (11) is installed on the said circuit means, the prong means to providing power to the circuit means to cause the LED light means to have single light color output and single function. Also, the embodiment (B') lacks eye-catching light effects because the LED (11F) is bigger than the plastic piece (11E) and the majority of light beams are wasted and the light effects are much worse than those of the current invention.

Figure 1:
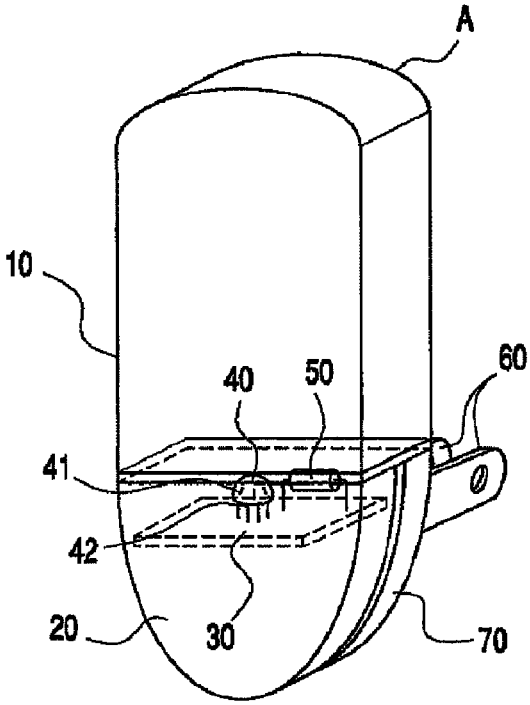
FIGS. 1, 1C and 1D illustrate a first embodiment of the current invention.
Figure 1C:
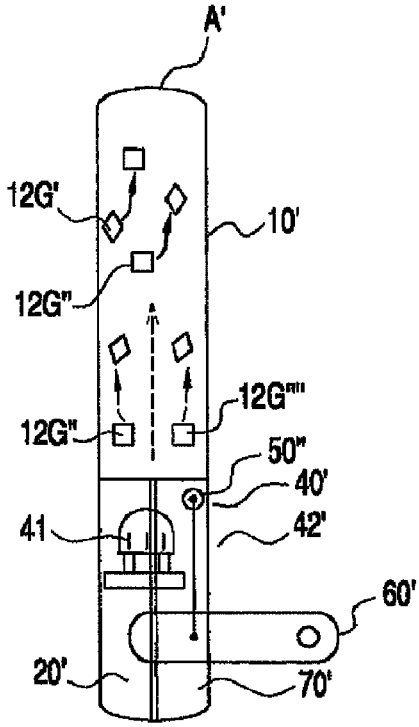
Figure 1D:
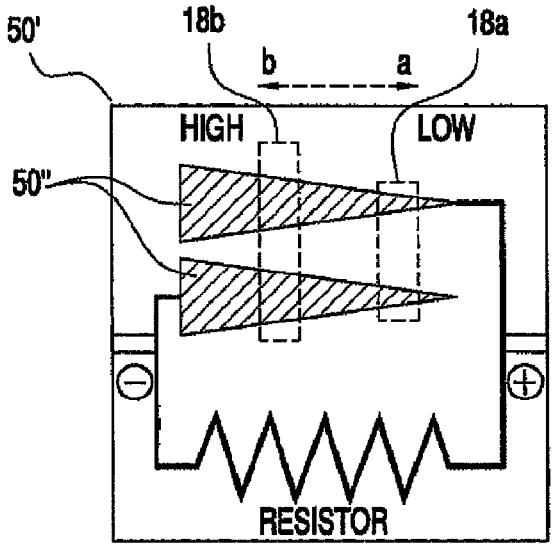

As shown in FIG. 1, the first embodiment of an LED night light (A) according to the invention has an upper housing (10), front base (20), and back base (70) with prong means (60) extending from a rear surface of the back base (70). A single LED light means (40) is installed on the circuit means (30) with at least 3 die inside the LED body to allow the multiple color light beam to be emitted out from the LED light means while the circuit means (30) offers the proper electric signals to the said LED. A heater means (50) disposed within the housing space has a certain temperature on its surface when electricity passes through the heater means. It can be connected with the prong means in parallel connection and does not have any relation with the circuit means as individual heat function. As shown in FIG. 1 and FIG. 1D, the heater means (50) as disclosed above can be in the form of a printed circuit board (PCB) (50') with pre-designed narrow to wider path (50") to make the electric current pass from small current to bigger current and cause the heater means to change from a lower to higher temperature, the movable conductive element (18A) being movable from position (a) to (b) so the current crossing the conductive element (18A) will change from a small current to bigger current and cause the resistor go from a lower to higher temperature. The heater means (50') connects with prong means on the position (+) and (−) with super thin space requirement because the PCB is very thin.

FIG. 2C shows a side view of the embodiment of FIG. 1, including disclosure the night light (A') with a top housing (10'), front base (20') and back base (70') with heaters means (50") parallel connected with the prong means (60') to provide heat to an upper space. The heated air will supply the upper housing bottom with heat to cause the inner medium means (not shown) and miniatures means (12G') (12G") (12G'") (12G"") to be moved. The preferred medium means and miniatures means may be the same as disclosed above.

Figures 1, 8:
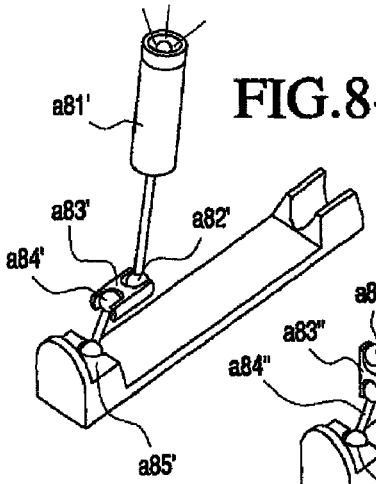
FIG. 8 shows an orientation adjustable LED light kit featuring 360 degree adjustment through a plurality of ball joint means.
Figures 2, 8:
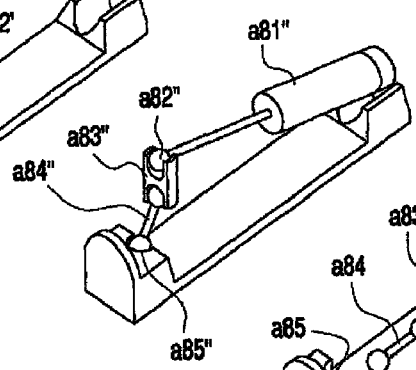
Figure 8:
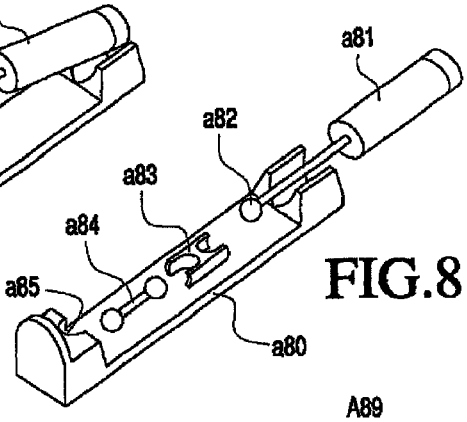

As shown in FIG. 2, the night light (E) of the current invention may according to a second preferred embodiment have an upper housing (18L), front base (18K), and back base (18C). Multiple sealed LED units (18G) are disposed within the housing and connected with circuit means (18D) to emit a light beam to the upper housing (18L) to be seen by a viewer. The light arrangement causes the light to be indirectly seen by the viewer. The circuit means (18D) has a built-in plurality of functions as discussed above with respect to functions (f1) to (f11). The night light may have a first function performance while the prong means (18B) is connected with a power source (not shown). A switch means (18M) on the proper location on the front base (18K) or (18C) allows people to select the next function from the plurality of functions built inside of the circuit means (18D). At least one of the heater means (18I) (18J) are disposed within the front and back base adjacent to the bottom of the top housing (18K) to offer sufficient heat to the top housing (18L) to cause the medium means (not shown) and miniature means (not shown) to move in response to the heat. The heater means may also have an alternative arrangement which uses a PCB as disclosed above.

Element (F) is a lower part of night light (E) shown from the rear to expose the arrangement of the heat means (19A)

(19B) (19I) on the upper location and adjacent to the top housing bottom. The multiple LEDs (19D) are arranged at the center location of the base to offer the light to the top housing for best coverage of the limited LED emitting angle. The prong means (19H) are installed on the back base (19C) to connect to a power source.

FIG. 3A shows the apertures, opening, or slot arrangement on the front base of element (F) that allow the heat means's heat to be as much as possible. As shown in FIG. 3B, a big opening or cut-out may be arranged to get same function apertures, openings, or slots of FIG. 3A. FIG. 3C shows a design for assembling the top housing (18L') to the front base (18K) by inserting two "L" shape plastic bolts (25A) (25B) into the front base's slot (25A') (25B'), with s recess arrangement after assembly.

Figure 4:
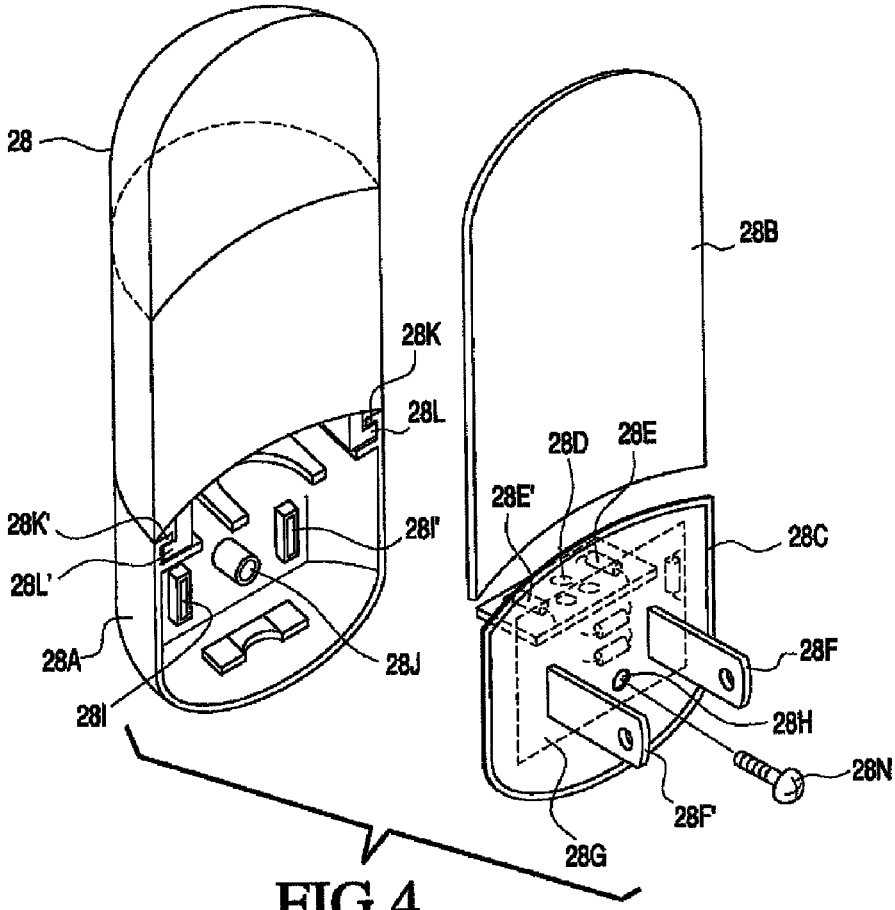
FIG. 4 shows details of the first embodiment including an LED night light with liquid optics medium.

FIG. 4 shows details of the assembly of the first embodiment, including a top housing (28), front base (18A), back base (28C), and top housing back plate (28B), the front base (28A) being assembled with back base (28C) by a screw (28N). The top housing (28) slides into the slots of the front base as shown in FIG. 3C. The top housing (28) has a back plate (28B) to allow the medium means and miniature means to be securely installed inside and sealed by a safety procedure to prevent the inner medium means from having a leakage problem. The heat means (28E) (28E') disposed within the front base and back base at a higher position to enable heat to cause movement in the medium means. A circuit means and switch means disposed within the front base and back base drives the LEDs (28D) to exhibit a plurality of light functions and can be changed to the next function while operating the switch means from the outside surface of the night light.

Figure 5:
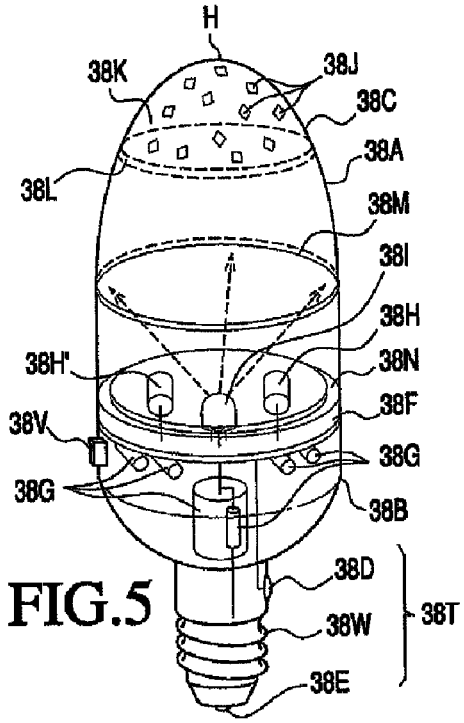
FIG. 5 shows a second embodiment of an LED night light with liquid optics medium in a C7 size bulb shape with a built-in liquid optics medium arrangement.

FIG. 5 shows an LED night light that fits into a conventional bulb holder (not shown). The bulb shape embodiment (H) has an upper portion (38C) containing medium means (38K) and miniatures means (38J) with a divider (38L) to separate the upper portion from the rest of the space of the top housing (38A). The upper portion (38C) space can be larger or smaller depending on market requirements as long as the lower or upper location are to get to. The top housing (38A) may be connected with the lower housing (38B) by conventional skill such as ultrasonic welding, chemical glue, or solvent to solid join the top housing and lower housing together. The lower housing (38B) includes a circuit means (38F), light means (381), heat means (38H) (38H'), and electric components (38G) disposed within with proper sealing means to fix on location. The circuit means (38F) connects with the screw base's (38W) electrodes (38D) (38E) to provide the electric power source. At least one switch means (38V) on the night light's outside surface allows people to make a function-change from a first function to a next function when needed.

This bulb shape embodiment can replace all current conventional-market gas-filled bulbs, including the medium means and miniature means, when the LED bulb's screw base (38T) is connected with the night light bulb receiving socket (not shown). The LED bulb will emit light when electricity is delivered from the night light's prong means to the LED bulb after passing though the night light receiving socket, the bulb's screw base's electrodes, and the circuit means to the LED light means. The bulb shape LED light has a switch means to cause a function-change from a first function performance to a next function which may be selected from the above-discussed functions (f1) to (f11) for a possible 11×11 assortments.

The bulb shape LED light for night light application will be a simple replacement for any people from kids to the aged, with most safety procedures. It is also very good for function selection, by operating the switch means to switch to any of the plurality functions provided by the IC chips.

Figure 6:
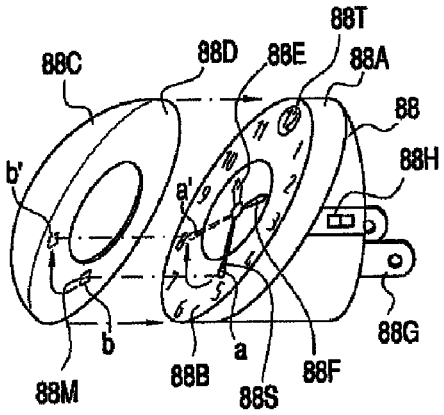
FIG. 6 shows a third embodiment of an LED night light with liquid optics medium which is incorporated with a time piece movement and magnetic means on the miniature means base and a time piece's second arm to make the miniature means move each second within the liquid medium. In this embodiment, the center area of the liquid medium container is clear so one can see the minute and hour arms though the medium container center areas. The LEDs can be arranged on the dial face at the 3, 6, 9, and 12 o'clock positions with precise location for illumination as a night light, or LEDs may be located at more positions from 1 to 12 locations.

FIG. 6 shows a night light that is further incorporated with another device according to an embodiment of the current invention. The LED night light with liquid optics medium of this embodiment has a top housing (88C) and the lower housing (88) which have a clock movement (88A) with hour arm (88E), minute arm (88F), and second arm (88S) to show the time on the dial face (88B). The dial face with 1 to 12 markings can use LED light means (88T) provide illumination with a second color. The rest of the markings can have the first color for illumination. The second arm (88S) with magnetic means on the tip will make the magnetic miniature means (88M) follow the second arm's movement and make a circular movement in response to the second arm's movement per second. The preferred heat means can be optional for this application because the magnetic means for the miniature means (88M) and second arm (88S) is already very eye-catching.

Figure 7:
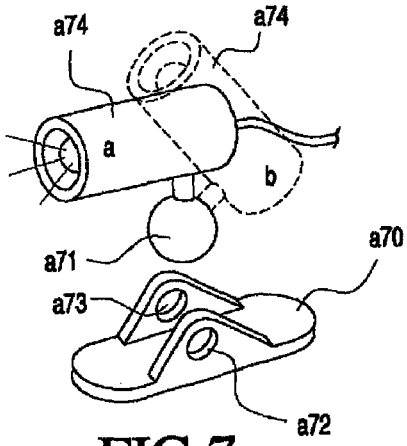
FIG. 7 shows an orientation adjustable LED light kit in which orientation is adjustable through its base.

FIG. 7*e* shows a preferred embodiment in the form of LED light kits having a base (a70) and adjustable orientation light tube. The light tube (a74) has a ball joint base (a71) which clips into the holes (A72) and (A73) to allow the position to change from (a) to (b) so as to move the light tube (a74) to a different orientation.

Figure 9:
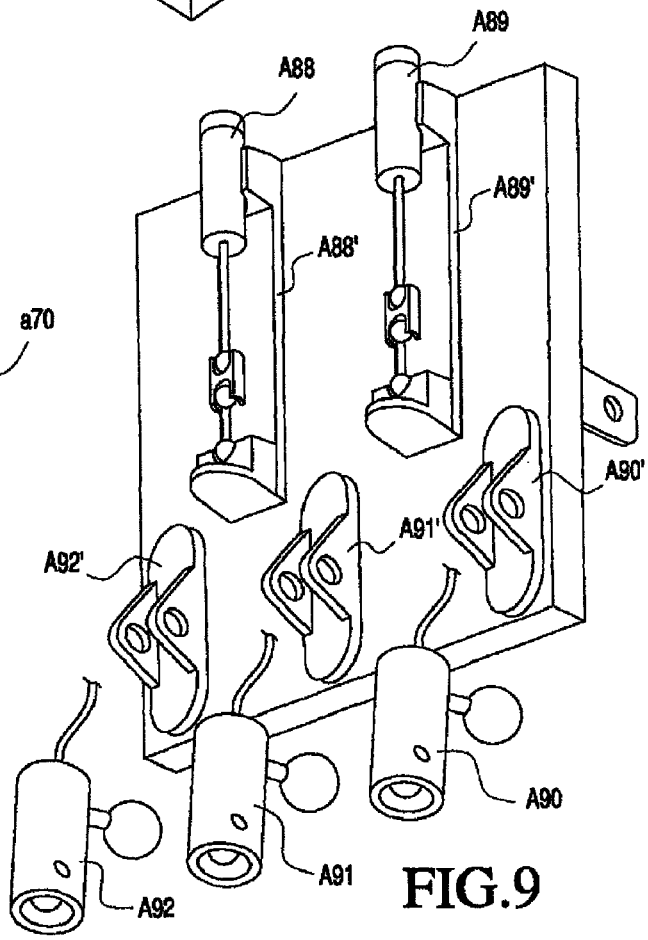
FIG. 9 shows a light with built-in LED light kits with desired orientation adjustment features.

FIG. 8 shows an up-grade embodiment having 360 degree orientation changing features that utilize a plurality of ball joint means (a82), (a84), the ball joint means clipping into the two ball end bars (a83) to form the 360 degree adjustable orientation means. so that light can be emitted in different directions as illustrated in FIGS. 8-1) and FIGS. 8-2). A plurality of ball joint means and ball end bar combinations may also be applied so that the LED night light can emit light in multiple directions (FIG. 9) with preferred circuit means to cause the plurality of LED light kits to have desired light functions such as the above-discussed functions (f1) to (f12) of LED light kits (A90) (A91) (A92) (A88) (A89). When the selected function is steady on, the light kits can make a good light device to assemble complicated computer wires under a table with the orientation light providing working lamp functions. It may also be preferred to incorporate a sound sensor selected from one of the control means to cause the light to exhibit sequential flashing as a Disco light for party use. This will be the most low end cost for party application for indoor or outdoor activity as long as enough extension cords are provided.

Figure 10:
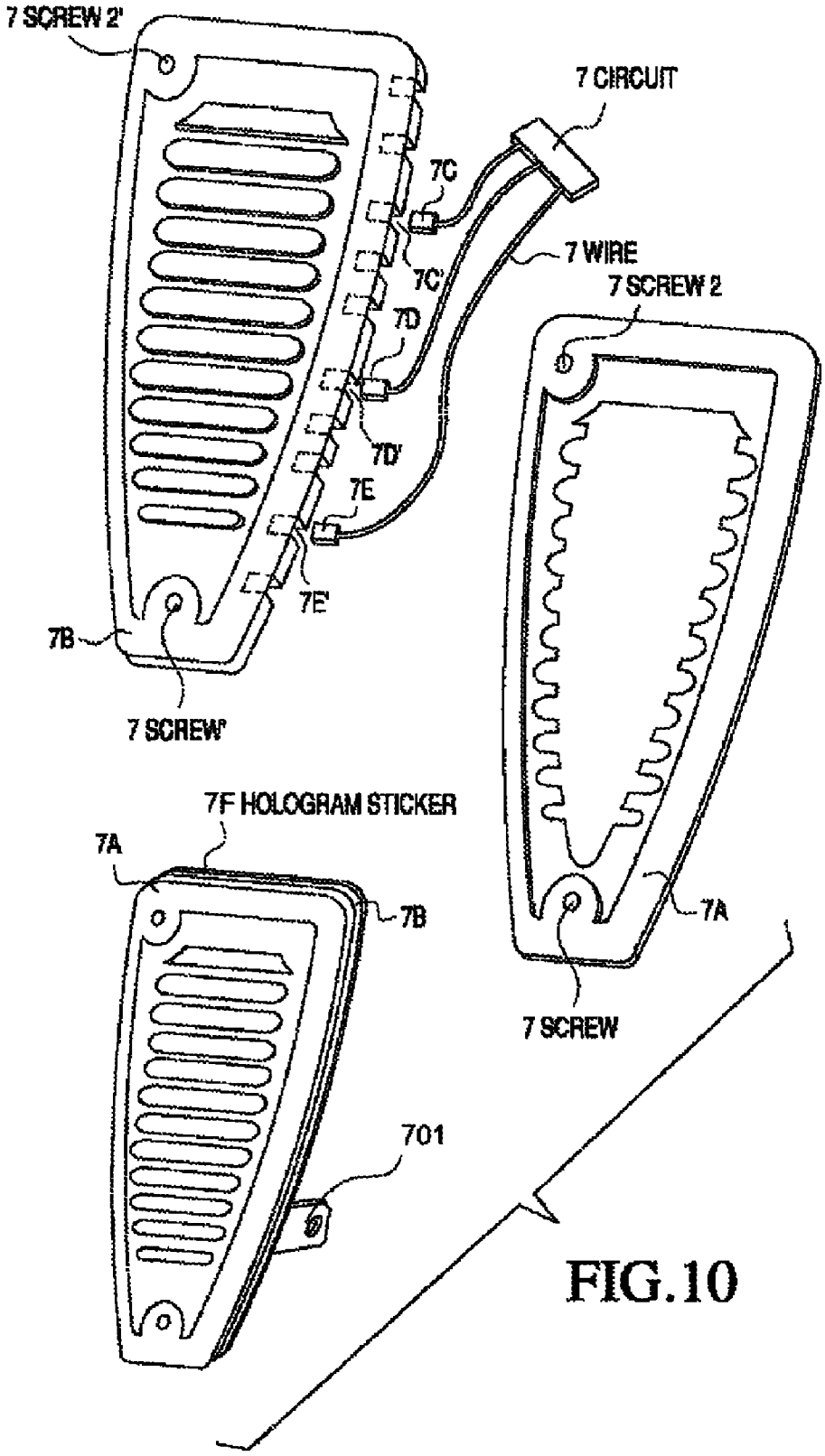
FIG. 10 shows an LED night light construction with a rigid optical medium to provide a light arrangement through a front metal stencil piece with a plurality of LEDs to provide desired light color change with functions changing from circuit means.

FIG. 10 shows a preferred embodiment having a rigid optics medium (7B) underneath a front stencil means (7A) to form a very nice quality LED night light. The LED night light (700) with rigid optics medium (7B) includes:

- at least one prong means (701) built-in to the night light to supply electricity to a light means (7C) (7D) (7E) while the prong means are connected with a power source;
- at least one light means (7C) (7D) (7E) which may be selected from the group a die, chip, and sealed unit of an LED to provide a light source with a certain range of wavelengths visible to viewers and incorporating a related circuit means to offer illumination under predetermined time, functions, brightness, colors and duration;
- at least one rigid medium means (7B) which may be selected from the group including (m2) a solid plastic body, (m3) transparent material, or (m4) any medium means which can subject light traveling within to reflective, diffusion, or other optical properties, and which may incorporated with the LED light source to increase the value, appearance, or accent of the night light;

at least one cosmetic media (7F) adjacent to the rigid optics means which may be any material such as (bg 1) a shell, (bg 2) leaves, (bg 3) dry flower, (bg 4) potpourri, (bg 5) flower, (bg 6) plastic piece, (bg 7) floating stuff, (bg 8) fish, (bg 9) animals, (bg 10) smiling face, (bg 11) metal piece, (bg 12) paper piece, (bg 13) wood piece, (bg 14) seed, (bg 15) boat, (bg 16) snow flake, (bg 17) tree, (bg 18) hologram piece, or (bg 19) any material with a desired shape and colors and/or with a design, indicia, drawing, color, painting, or coating available to put behind. underneath. or adjacent to the medium means to increase the value of its appearance by causing the medium means to look like conventional gift items which include a scene inside, such as seasonal water ball, artificial aquarium, or kid's toy with sealed liquid applications, thereby solving the problem of the ugly appearance of the majority of LED light kits problem, which is very bad for the market place because consumers do not like to buy the LED light if the night light can beam can only be seen at night time and does not have a cosmetic appearance on the surface; and at least one stencil means (7A) made of an (m1) plastic, (m2) metal, or (m3) aluminum piece, (m4) wood, (m5) textile (m6), pottery (m6), or porcelain in front of the rigid medium means to provide a pretty appearance and which is connected with a proper housing member of the night light by fastening means, enhancing the appearance value of the parts and increase sales.

The LED night light with a rigid optics medium may incorporate proper circuit means (7 circuit) through wires (7 wires) which can have a desired function selected from the group including (f1) steady, (f2) chasing, (f3) random, (f4) fade in and fade out, (f5) sequential, (f6) pair flashing, (f7) scan, (f8) color mixed, (f9) color changing, (f10) all flashing or (f11) any combination of light effects available on the market. All these functions can be designed to have a predetermined time, duration, order, and function as required. These circuit means can provide the light means (7C) (7D) (7E) with splendid light effects though the rigid medium and hologram cosmetic means. The hologram cosmetic means can also have laser grating features so at to also create some other optics properties to increase the value of the night light.

Because the night light of this embodiment has a rigid optics medium means, through which a desired light beam from an LED passes through, the night light does not need to incorporate a heater means to make the medium means and miniature means change position by heat created from the heater means.

As described above, the night light of this embodiment may exhibit a first function when the prong means is connected with a power source and can be changed to a next function from a group of functions through switch means operation.

The preferred embodiment is intended to exemplify the spirit of the current invention but should not limited to the above described embodiments. For example, the light means may include fiber optics arranged on a main objects to let a viewer see a certain range of the visible wavelength of light.

The invention claimed is:

1. A multiple light source night light, including:

at least two light source sets installed within a housing, said housing including a plurality of openings, cut-outs, or windows through which light emitted by said two light source sets is visible to a viewer, said two light source sets emitting light according to a predetermined timing, duration, brightness, function, and performance; and decorative means incorporated with the said housing, and which are in addition to said openings, cut-outs, or windows to make said night light have a valuable appearance and selected from the group consisting of any combination of fiber optics, a solid plastic injection with air inside, a liquid medium unit with miniature stuff inside, a liquid medium unit with reflective stuff inside, a liquid medium unit with desired stuff inside, and a stain-glass device, wherein said two of light source sets include first and second light sets, both of which are LEDs, the improvement wherein:

the first and second light source sets emit single color light beams to viewers while the prong means connect to a power source, the night light is arranged to incorporate a switch means or sensor means for causing the LEDs to turn on and off, and light beams from the first and second light source sets respectively pass directly to a viewer along different paths through different parts or areas of the night light or decorative means without passing through a same optical element, said light beams from the first and second light source sets also being respectively blocked by other different parts or areas of the night light or decorative means without first passing through the same optical element.

* * * * *